US005870899A

United States Patent [19]

Choi

[11] Patent Number: 5,870,899

[45] Date of Patent: Feb. 16, 1999

[54] METHOD FOR CONTROLLING A PAUSING PERIOD OF A DEFROSTING OPERATION OF A REFRIGERATOR

[75] Inventor: Byung-Joon Choi, Incheon, Rep. of Korea

[73] Assignee: Daewoo Electronics Co., Ltd., Rep. of Korea

[21] Appl. No.: 866,061

[22] Filed: May 30, 1997

[30] Foreign Application Priority Data

Aug. 31, 1996 [KR] Rep. of Korea ..... 1996 37506

[51] Int. Cl.[6] ..... F25D 21/06

[52] U.S. Cl. ..... 62/155; 62/156

[58] Field of Search ..... 62/155, 156, 151, 62/234, 140

[56] References Cited

U.S. PATENT DOCUMENTS

| | | | |
|---|---|---|---|
| 3,103,794 | 9/1963 | Kyle et al. | 62/140 X |
| 3,453,837 | 7/1969 | Sandstrom et al. | 62/156 X |
| 3,774,406 | 11/1973 | Reitblatt | 62/156 X |
| 4,178,767 | 12/1979 | Shaw | 62/155 |
| 5,228,300 | 7/1993 | Shim | 62/80 |

*Primary Examiner*—Harry B. Tanner

*Attorney, Agent, or Firm*—Pillsbury Madison & Sutro, LLP

[57] ABSTRACT

Disclosed is a controlling method for minimizing a temperature deviation in a refrigerator by optimally varying a pausing period of a defrosting operation based on a present temperature in the refrigerator and the pressure of the discharging outlet of a compressor. A controlling section removes frost formed at the evaporation of a freezing compartment during the common operation of the refrigerator and stops the operation of a heater for the defrosting operation. In order to stabilize the temperature in the refrigerator, the controlling section compares the temperature in the refrigerator with the operating temperature of the compressor during the pausing period. When the temperature in the refrigerator is not less than the operating temperature of the compressor, the controlling section compares the pressure of the discharging outlet of the compressor with the operating pressure of the compressor. When the pressure at the discharging outlet of the compressor is not less than a reference pressure, the controlling section drives the compressor to transform the operation of the refrigerator into a common operation. Accordingly, the temperature deviation in the refrigerator can be minimized and the food stored in the refrigerator can be maintained in an its optimal fresh state. Further, the consuming power of the refrigerator can be reduced.

10 Claims, 2 Drawing Sheets

METHOD FOR CONTROLLING A PAUSING PERIOD OF A DEFROSTING OPERATION OF A REFRIGERATOR

BACKGROUND OF THE INVENTION

1. Field of the Invention

The present invention relates to a method for controlling a pausing period of a defrosting operation for minimizing a temperature deviation in a refrigerator through the optimum variation of the pausing period of the defrosting operation based on the present temperature in the refrigerator and the present pressure of the discharging outlet of a compressor.

2. Description of the Prior Art

Generally, a refrigerator includes a heater for a defrosting operation for removing frost formed around an evaporator. When the accumulated operating time of a compressor is a first predetermined time (for example, 8 hours) or over, a controlling apparatus for the refrigerator selects a defrosting mode without any condition and carries out the defrosting operation. In addition when the accumulated operating time of the compressor is a second predetermined time (for example, 5 hours) or over, the controlling apparatus for the refrigerator reads the accumulated time for a door opening, the operating ratio of the compressor, etc. and carries out the defrosting operation.

When the defrosting mode is selected, the controlling apparatus for the refrigerator operates the heater for the defrosting operation and detects the temperature around the evaporator through a defrosting sensor. When the detected temperature is a predetermined restoring temperature for the defrosting operation (for example, 13° C.) or over, the operation of the heater for the defrosting operation (i.e. a heat generating operation) is stopped. Meanwhile when the detected temperature is the restoring temperature for the defrosting operation or below, the heater for the defrosting operation is operated for a predetermined time (for example, for 90 minutes) and then the operation thereof is stopped.

After the operation of the refrigerator at the defrosting mode as described above, the temperature in the refrigerator is usually −10° C. or over. If the refrigerator is commonly operated, the temperature in the refrigerator is about −16° C.~−20° C. After the defrosting operation and during the pausing period of the defrosting operation, which is fixed as a predetermined time interval (for example, 4~7 minutes), the temperature in the refrigerator can be further increased.

In order to lower the increased temperature in the refrigerator to the temperature in the refrigerator during the common operation, the operating time of the compressor should be increased. This will increase the consuming power of the refrigerator. In addition, the temperature in the refrigerator at the common operating mode of the refrigerator is different from the temperature in the refrigerator at the defrosting mode. Therefore, it is difficult for food stored in the refrigerator to keep in an optimally fresh state.

Accordingly, the method for controlling the defrosting operation as described above fixes the pausing period of the defrosting operation irrespective of the temperature in the refrigerator after the defrosting operation and induces the increase in the temperature of the refrigerator.

A method for automatically controlling the operation of the refrigerator is disclosed in U.S. Pat. No. 5,228,300 (granted to Shim). In this patent, the operations of the compressor and a fan motor are delayed after the completion of a defrosting cycling for minimizing the increase of the temperature in the refrigerator. And in the controlling method, the temperature setting of a chamber, the defrost cycling and the operation of a compressor and a fan motor are automatically controlled according to the the door open/close frequency and open time. According to the present state of a temperature adjusting apparatus and the mean temperature of the refrigerator, the temperature in the refrigerator is lowered and the defrosting cycling is operated for a predetermined time interval or an auxiliary time interval according to the utilization number of the refrigerator and the opening time of the door before the defrosting cycle. The operations of the compressor and the fan motor are delayed so that the temperature in the refrigerator is not increased after the completion of the defrosting cycling to minimize the temperature variation in the refrigerator and to protect the stored food.

However, after the defrosting operation, the method for controlling the defrosting operation as described above could not actively cope with the increase in the temperature in the refrigerator and with the increase in the consuming power of the refrigerator. Therefore, the pausing period of the defrosting operation could not be optimally varied.

SUMMARY OF THE INVENTION

Accordingly, it is an object of the present invention to provide a controlling method for optimally determining the pausing period of a defrosting operation based on the present temperature of a refrigerator and the present pressure of a discharging outlet.

Another object of the present invention is to provide a controlling method for minimizing a temperature deviation in the refrigerator and reducing a consuming power through operating a compressor at an optimal time according to the optimally determined pausing period of the defrosting operation.

To accomplish the above objects, there is provided in the present invention a method for controlling a pausing period of a defrosting operation of a refrigerator comprising the steps of:

(a) removing frost formed at an evaporator in a freezing compartment during a common operation of the refrigerator and stopping an operation of a heater which operates to remove the frost;

(b) comparing a temperature in the refrigerator with a reference temperature while pausing the operation of the refrigerator in order to stabilize the temperature in the refrigerator;

(c) comparing a pressure of a discharging outlet of a compressor with a reference pressure when the step (b) judges that the temperature in the refrigerator is not less than the reference temperature; and (d) transforming the operation of the refrigerator by driving the compressor when the step (c) judges that the pressure of the discharging outlet of the compressor is not less than the reference pressure.

In the method for controlling the pausing period of the defrosting operation of the refrigerator according to the present invention, the pausing period after the defrosting operation, which has been commonly fixed, is optimally varied and is transformed into the common operation of the refrigerator at an optimum time, based on the present temperature of the refrigerator and the present pressure of the discharging outlet. Accordingly, the temperature deviation in the refrigerator is minimized and the freshness of the food stored in the refrigerator can be optimally maintained. Further, the consuming power of the refrigerator can be reduced.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Hereinafter, the constituting elements and the operating principles of the method for controlling the pausing period of the defrosting operation in the refrigerator according to the present invention, will be explained in more detail with reference to the accompanying drawings.

Figure 1:
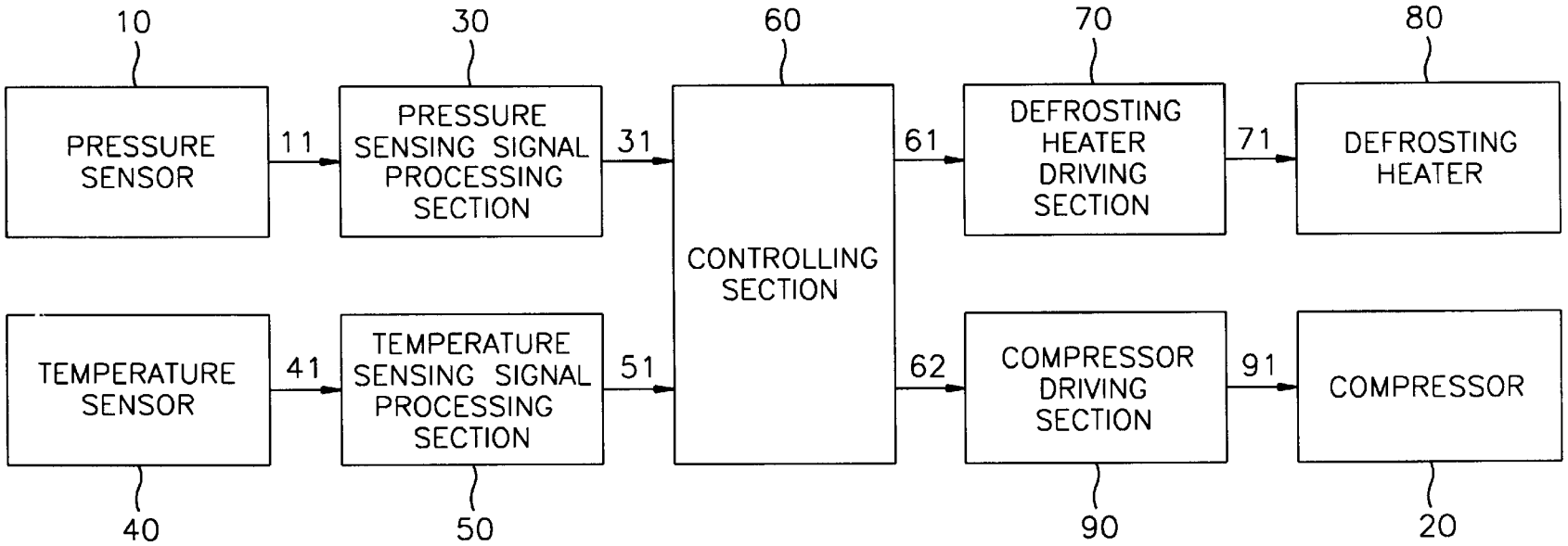
FIG. 1 is a circuit block diagram for showing the constitution of an apparatus for controlling a pausing period after the defrosting operation of a refrigerator.

FIG. 1 is a circuit block diagram for showing the constitution of the apparatus for controlling the pausing period after the defrosting operation of the refrigerator. As shown in FIG. 1, a pressure sensor 10 is installed at the discharging outlet of a compressor 20 and senses a pressure in compressor 20 to output a sensed pressure signal 11.

A pressure sensing signal processing section 30 transforms sensed pressure signal 11 from pressure sensor 10 into an electric signal which is appropriate for a signal treatment, to provide a transformed pressure signal 31.

A temperature sensor 40 senses a temperature in the refrigerator and outputs a sensed temperature signal 41.

A temperature sensing signal processing section 50 transforms sensed temperature signal 41 from temperature sensor 40 into an electric signal which is appropriate for a signal treatment, to provide a transformed temperature signal 51.

A controlling section 60 compares transformed pressure signal 31 from pressure sensing signal processing section 30 with a predetermined reference pressure and transformed temperature signal 51 from temperature sensing signal processing section 50 with a predetermined reference temperature to respectively provide first and second controlling signals 61 and 62.

A defrosting heater driving section 70 inputs first controlling signal 61 from controlling section 60 and applies a heater driving signal 71 to a defrosting heater 80 which is connected with the rear terminal of defrosting heater driving section 70.

A compressor driving section 90 inputs second controlling signal 62 from controlling section 20 and applies a compressor driving signal 91 to compressor 20 which is connected to the rear terminal of compressor driving section 90.

Referring to the flow chart of FIG. 2, the transforming process of the refrigerator at an appropriate time by optimally varying the pausing period after the defrosting operation based on the pressure of the discharging outlet of the compressor and the temperature in the refrigerator using the controlling apparatus having the above-mentioned constitution, will be described below.

Figure 2:
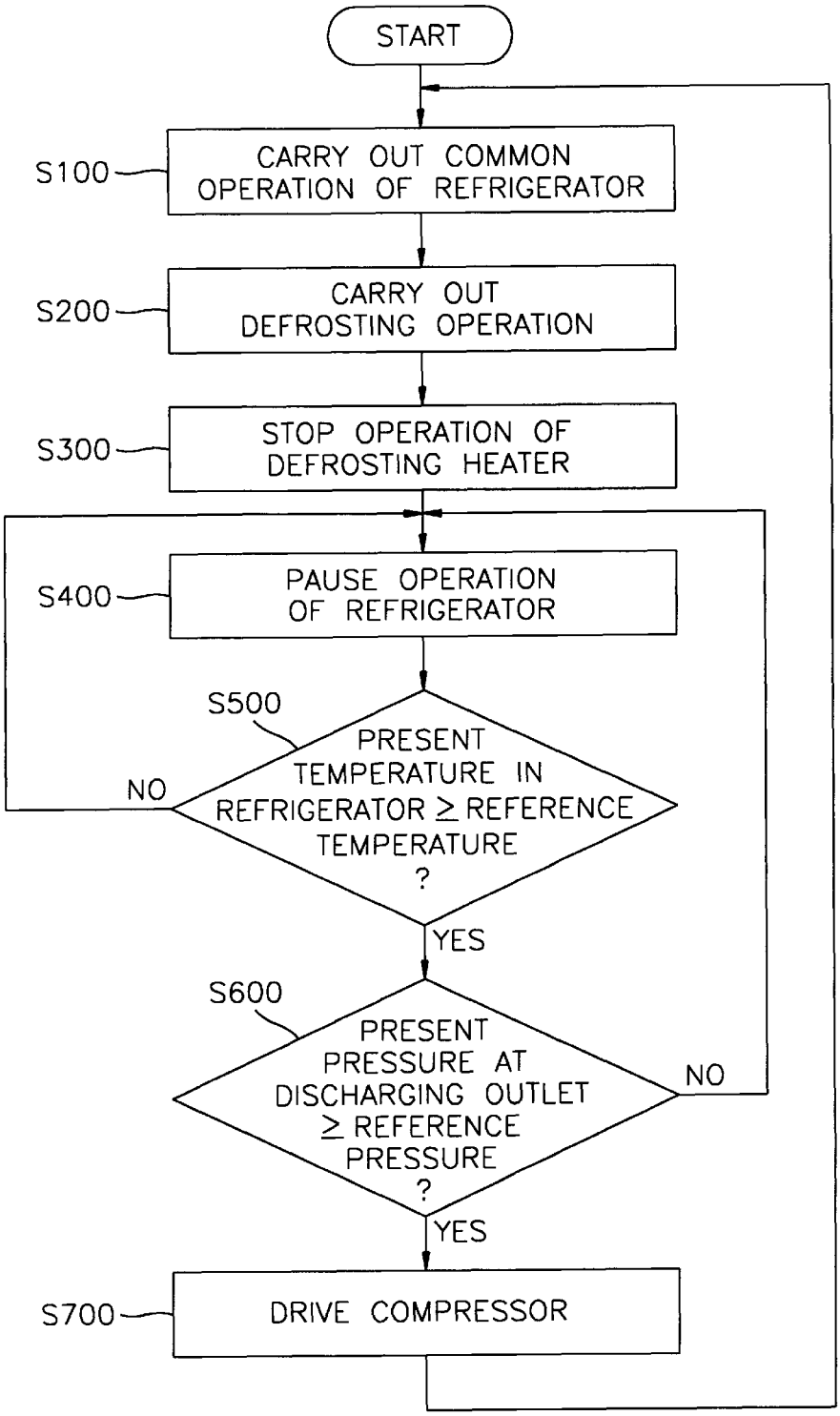
FIG. 2 is a flow chart for explaining a method for controlling the pausing period of a defrosting operation in a refrigerator by the apparatus illustrated in FIG. 1.

FIG. 2 is the flow chart for explaining the method for controlling the pausing period of the defrosting operation in the refrigerator by the apparatus illustrated in FIG. 1. As illustrated in FIG. 2, controlling section 60 carries out a common operation of the refrigerator at step S100. While carrying out step S100, controlling section 60 applies first controlling signal 61 to defrosting heater driving section 70 to drive defrosting heater 80. That is, the defrosting operation is carried out (step S200). After removing frost through step S200, controlling section 60 stops the operation of the defrosting heater at step S300.

Controlling section 60 pauses the operation of the refrigerator for a predetermined time in order to stabilize the temperature in the refrigerator at step S400. While carrying out step S400, controlling section 60 compares the temperature in the refrigerator with the reference temperature through temperature sensor 40 and judges if the temperature in the refrigerator is not less than the operating temperature of compressor 20 (step S500). If the temperature in the refrigerator is lower than the operating temperature of compressor 20, controlling section 60 carries out step S400.

When step S500 judges that the temperature in the refrigerator is not less than the operating temperature of compressor 20, controlling section 60 compares the pressure at the discharging outlet of compressor 20 with the reference pressure through pressure sensor 10 and judges if the pressure at the discharging outlet is not less than the operating pressure of compressor 20 (step S600). If the pressure at the discharging outlet of compressor 20 is lower than the operating pressure of compressor 20, controlling section 60 carries out step S400.

When step S600 judges that the pressure at the discharging outlet of compressor is not less than the operating pressure of compressor 20, controlling section 60 applies second controlling signal 62 to compressor driving section 90 to drive compressor 20 (step S700).

Controlling section 60 carries out step S100 again while carrying out step S700 for the common operation of the refrigerator.

In the method for controlling the pausing period of the defrosting operation of the refrigerator according to the present invention, the pausing period after the defrosting operation, which has been commonly fixed, is optimally varied and is transformed into the common operation of the refrigerator at an optimum time, based on the present temperature of the refrigerator and the present pressure of the discharging outlet. Accordingly, the temperature deviation in the refrigerator is minimized and the freshness of the food stored in the refrigerator can be optimally maintained. Further, the consuming power of the refrigerator can be reduced.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. A method for controlling a pausing period of a defrosting operation of a refrigerator, said method comprising the steps of:

(a) removing frost formed at an evaporator in a freezing compartment during a common operation of said refrigerator and stopping an operation of a heater which operates to remove the frost;

(b) comparing a temperature in said refrigerator with a reference temperature while pausing the operation of said refrigerator in order to stabilize the temperature in said refrigerator;

(c) comparing a pressure of a discharging outlet of a compressor with a reference pressure when said (b)

judges that the temperature in said refrigerator is not less than the reference temperature; and (d) transforming the operation of said refrigerator by driving said compressor when said step (c) judges that the pressure of said discharging outlet of said compressor is not less than the reference pressure.

2. The method for controlling a pausing period of a defrosting operation of a refrigerator as claimed in claim 1, wherein said reference temperature and the reference pressure are respectively set by a operating temperature of said compressor and by a operating pressure of said compressor.

3. The method for controlling a pausing period of a defrosting operation of a refrigerator as claimed in claim 1, wherein said step (a) comprises the substeps of:

(i) carrying out the common operation of said refrigerator;

(ii) removing the frost formed at said evaporator of said freezing compartment while carrying out said step (i); and (iii) stopping the operation of said heater after carrying out said step (ii).

4. The method for controlling a pausing period of a defrosting operation of a refrigerator as claimed in claim 1, wherein said step (b) comprises the substeps of:

(i) pausing the operation of said refrigerator for a predetermined time in order to stabilize the temperature in said refrigerator; and (ii) comparing the temperature in said refrigerator with the reference temperature and judging if the temperature in said refrigerator is not less than the operating temperature of said compressor during the pausing of the operation of said refrigerator in said step (i).

5. The method for controlling a pausing period of a defrosting operation of a refrigerator as claimed in claim 4, wherein said step (i) returns to said step (ii) when said step (ii) judges that the temperature in said refrigerator is lower than the operating temperature of said compressor.

6. The method for controlling a pausing period of a defrosting operation of a refrigerator as claimed in claim 1, wherein said step (d) comprises the substeps of:

(i) driving said compressor when said step (c) judges that the pressure of said discharging outlet of said compressor is not less that the operating pressure of said compressor; and (ii) returning to said step (a) after carrying out said step (i).

7. The method for controlling a pausing period of a defrosting operation of a refrigerator as claimed in claim 1, wherein said step (c) returns to said step (b) when said step (c) judges that the pressure of said discharging outlet of said compressor is lower than the moving pressure of said compressor.

8. A method for controlling a pausing period of a defrosting operation of a refrigerator, said method comprising the steps of:

(i) carrying out a common operation of a refrigerator;

(ii) removing frost formed at an evaporator of said refrigerator while carrying out said step (i);

(iii) stopping an operation of a heater for a defrosting operation after carrying out said step (ii);

(iv) pausing the operation of said refrigerator for a predetermined time in order to stabilize a temperature in said refrigerator;

(v) comparing the temperature in said refrigerator with a reference temperature and judging if the temperature in said refrigerator is not less than a operating temperature of a compressor during the pausing of the operation of said refrigerator in said step (iv);

(vi) comparing a pressure of a discharging outlet of said compressor with a reference pressure and judging if the pressure of said discharging outlet of said compressor is not less than the reference pressure when said step (v) judges that the temperature in said refrigerator is not less than the operating temperature of said compressor;

(vii) driving said compressor when said step (vi) judges that the pressure of said discharging outlet of said compressor is not less than the operating pressure of said compressor; and (viii) returning to said step (i) after carrying out said step (vii).

9. The method for controlling a pausing period of a defrosting operation of a refrigerator as claimed in claim 8, wherein said step (v) returns to said step (iv) when said step (v) judges that the temperature in said refrigerator is lower than the operating temperature of said compressor.

10. The method for controlling a pausing period of a defrosting operation of a refrigerator as claimed in claim 9, wherein said step (vi) returns to said step (iv) when said step (vi) judges that the pressure of said discharging outlet of said compressor is lower than the operating pressure of said compressor.

* * * * *